US008535103B2

(12) United States Patent
Lim et al.

(10) Patent No.: US 8,535,103 B2
(45) Date of Patent: Sep. 17, 2013

(54) ELECTRICAL CONNECTOR

(75) Inventors: Chin Hua Lim, Singapore (SG); Saujit Bandhu, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 130 days.

(21) Appl. No.: 13/147,817

(22) PCT Filed: Apr. 7, 2010

(86) PCT No.: PCT/US2010/030172
§ 371 (c)(1),
(2), (4) Date: Aug. 4, 2011

(87) PCT Pub. No.: WO2010/118086
PCT Pub. Date: Oct. 14, 2010

(65) Prior Publication Data

US 2011/0294362 A1 Dec. 1, 2011

(30) Foreign Application Priority Data

Apr. 9, 2009 (SG) ..... 200902464-7

(51) Int. Cl.
*H01R 13/415* (2006.01)

(52) U.S. Cl.
USPC ..... 439/741; 439/660

(58) Field of Classification Search
USPC ..... 439/660, 741
See application file for complete search history.

(56) References Cited

U.S. PATENT DOCUMENTS

| | | | | |
|---|---|---|---|---|
| 6,331,122 | B1 | 12/2001 | Wu | |
| 6,447,340 | B1 | 9/2002 | Wu | |
| 6,488,514 | B2 * | 12/2002 | Kubo et al. | 439/108 |
| D469,407 | S | 1/2003 | Wu | |
| 6,517,386 | B2 * | 2/2003 | Sakakura et al. | 439/676 |
| 6,743,060 | B2 * | 6/2004 | Wu | 439/741 |
| 6,832,934 | B1 | 12/2004 | Zhang | |
| 7,601,034 | B1 * | 10/2009 | Aekins et al. | 439/676 |
| 7,798,832 | B2 * | 9/2010 | Qin et al. | 439/188 |

(Continued)

FOREIGN PATENT DOCUMENTS

| | | | |
|---|---|---|---|
| WO | WO 95/18475 | A1 | 7/1995 |
| WO | WO 2008-000145 | A1 | 1/2008 |

OTHER PUBLICATIONS

Search Report for SG Application No. 200902464-7, pp. 5.
International Search Report for PCT/US2010/030172, pp. 3.

(Continued)

*Primary Examiner* — Truc Nguyen
(74) *Attorney, Agent, or Firm* — Robert S. Moshrefzadeh

(57) ABSTRACT

In one embodiment of the present invention, there is provided an electrical connector comprising an insulative housing having a longitudinal base with a first side and a second side. Extending from the base at the first side is a tongue portion having a first tongue section and a second tongue section, both sections having a first face and a second face. A plurality of passageways are defined on the first faces of both sections. Each of the passageways has a recess located at one end and a plurality of conductive contacts are received in the passageways. Each contact comprises a mating section, a mounting section and a retainer section bridging the mating section to the mounting section whereby the mating section of the contact is free to flex into the recess. In another embodiment of the present invention, there is provided an electrical connector having a socket extending from the base at the second side.

6 Claims, 8 Drawing Sheets

(56) References Cited

U.S. PATENT DOCUMENTS

| | | | |
|---|---|---|---|
| 2002/0013075 | A1 | 1/2002 | Kubo et al. |
| 2003/0224654 | A1 | 12/2003 | Wu |
| 2007/0155227 | A1 | 7/2007 | Ishizuka et al. |
| 2009/0017697 | A1 | 1/2009 | Zhu |

OTHER PUBLICATIONS

Written Opinion of the ISA for International Application No. PCT/US2010/030172, pp. 4.

* cited by examiner

ELECTRICAL CONNECTOR

CROSS REFERENCE TO RELATED APPLICATIONS

This application is a national stage filing under 35 U.S.C. 371 of PCT/US2010/030172, filed 07 Apr. 2010, which claims priority to Singapore Application No. 200902464-7 filed 09 Apr. 2009, the disclosure of which is incorporated by reference in its/their entirety herein.

TECHNICAL FIELD

The present invention relates to an electrical connector, in particular, an electrical connector adapted for high mating cycles.

BACKGROUND

The contacts in the connectors that are used in storage devices are generally firmly secured on the passageways configured on the mating parts. During the mating of a header connector with a complementary socket connector, the contacts at the tip of the mating part of the header connector get abraded as a result of the shear stress on the header connector's contacts by the complementary socket connector's contacts when the two connectors engage. Similar shear stress and abrasion occur when the two connectors disengage during the un-mating of the connectors. Repeated abrasion of the contacts during the mating and un-mating process wear the contacts which ultimately may result in an electrical connection failure. Conventional storage device connectors are designed to withstand an average life of 500 mating cycles.

Serial Advanced Technology Attachment (also referred to as SATA) connectors and Serial Attached SCSI (Small Computer System Interface) (SAS) connectors are examples of disk interface technologies in use.

U.S. Pat. Nos. 6,743,060, 6,331,122 and D469,407 disclose a type of SATA header connector which is to be mounted on a printed circuit board, a type of SATA socket connector which is to be mounted on a printed circuit board and an electrical connector assembly with a SATA connector as a part, respectively. U.S. Pat. No. 6,832,934 teaches a type of SAS connector.

The SAS header connector has generally the same configuration as the SATA header connector except that the SAS connector has a third tongue plate on which a third set of signal contacts are assembled on the surface opposing to the surface where the first two sets of contacts (including one set of power and one set of signal contacts) are assembled. In doing so, a SAS connector is compatible with a SATA connector and users have the ability to integrate either SAS or SATA devices and reduce the costs associated with supporting two different interfaces.

SUMMARY

It would be desirable to provide an electrical connector which is able to withstand high mating cycles of preferably greater than 500.

In accordance with one embodiment of the present invention, there is provided an electrical connector comprising an insulative housing comprising a longitudinal base having a mating side and a mounting side; a tongue portion extending from the longitudinal base at the mating side, the tongue portion comprising a first tongue section and a second tongue section, each tongue section having a first face and a second face; a plurality of passageways defined on the first faces of the first and the second tongue sections, the passageways extending from the tongue portion to the mounting side of the insulative housing; a recess located at one end of each passageway; and a plurality of conductive contacts received in the passageways, each contact comprising a mating section located at the mating side of the insulative housing, a mounting section located at the mounting side of the insulative housing, and a retainer section bridging the mating section to the mounting section; wherein the mating section of the contact is free to flex into the recess.

In accordance with another embodiment of the present invention, there is provided an electrical connector comprising an insulative housing comprising a longitudinal base having a first mating side and a second mating side; a tongue portion extending from the longitudinal base at the first mating side and a socket extending from the longitudinal base at the second mating side; wherein the tongue portion comprises a first tongue section and a second tongue section, each tongue section having a first face and a second face; a plurality of passageways defined on the first faces of the first and the second tongue sections, the passageways extending from the tongue portion at the first mating side to the socket at the second mating side; a recess located at one end of each passageway; and a plurality of conductive contacts received in the passageways, each contact comprising a first mating section located at the first mating side of the insulative housing, a second mating section located at the second mating side of the insulative housing, and a retainer section bridging the first mating section to the second mating section; wherein the first mating section of the contact is free to flex into the recess.

The invention further includes any alternative combination of parts or features mentioned herein or shown in the accompanying drawings. Known equivalents of these parts or features which are not expressly set out are nevertheless deemed to be included.

BRIEF DESCRIPTION OF THE DRAWINGS

An exemplary form of the present invention will now be described with reference to the accompanying drawings in which.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale. Like reference numbers have been used throughout the figures to denote like parts.

DETAILED DESCRIPTION

Figure 1A:
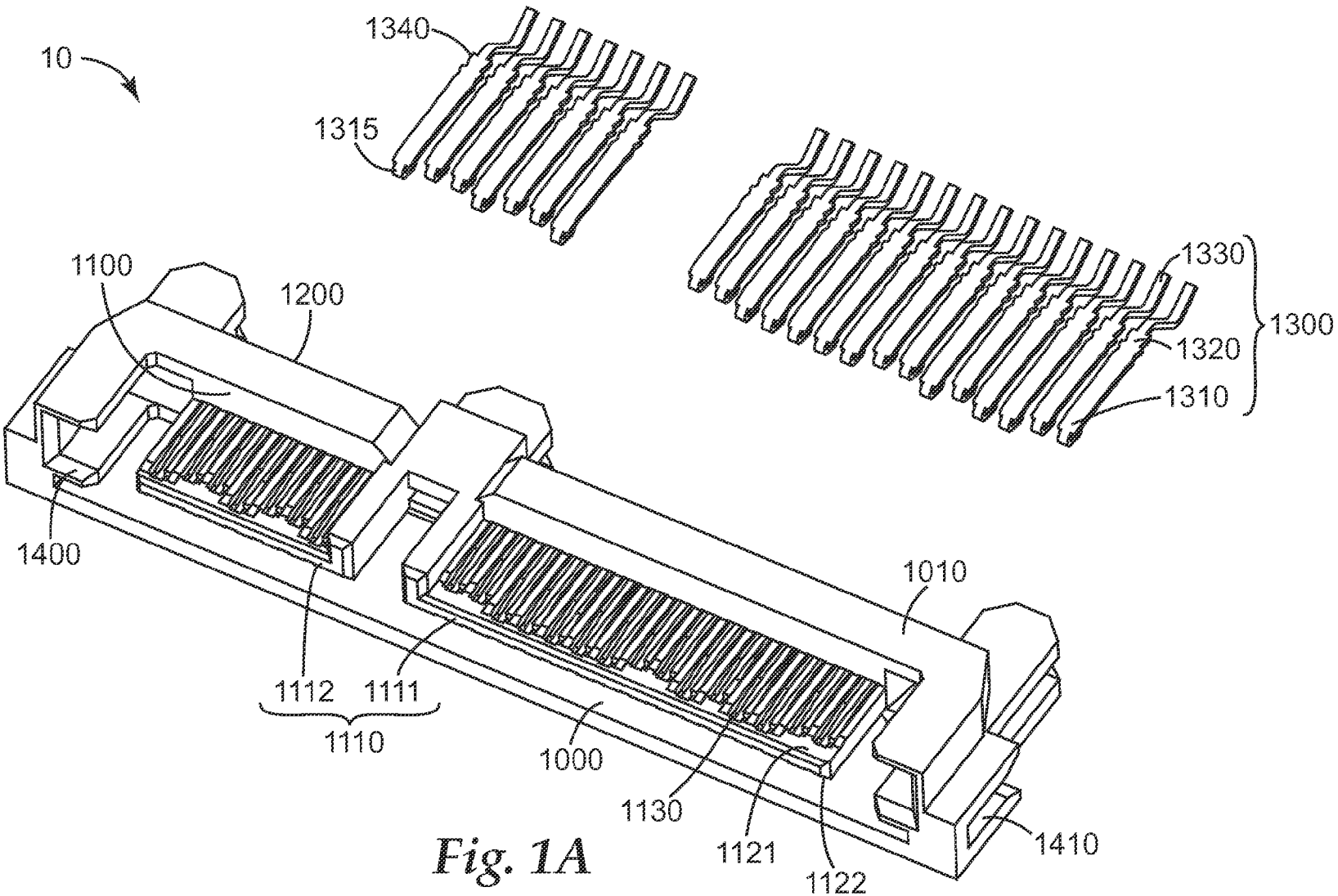
FIG. 1A is an exploded, perspective view of an electrical connector in accordance with the present invention.
Figure 1B:
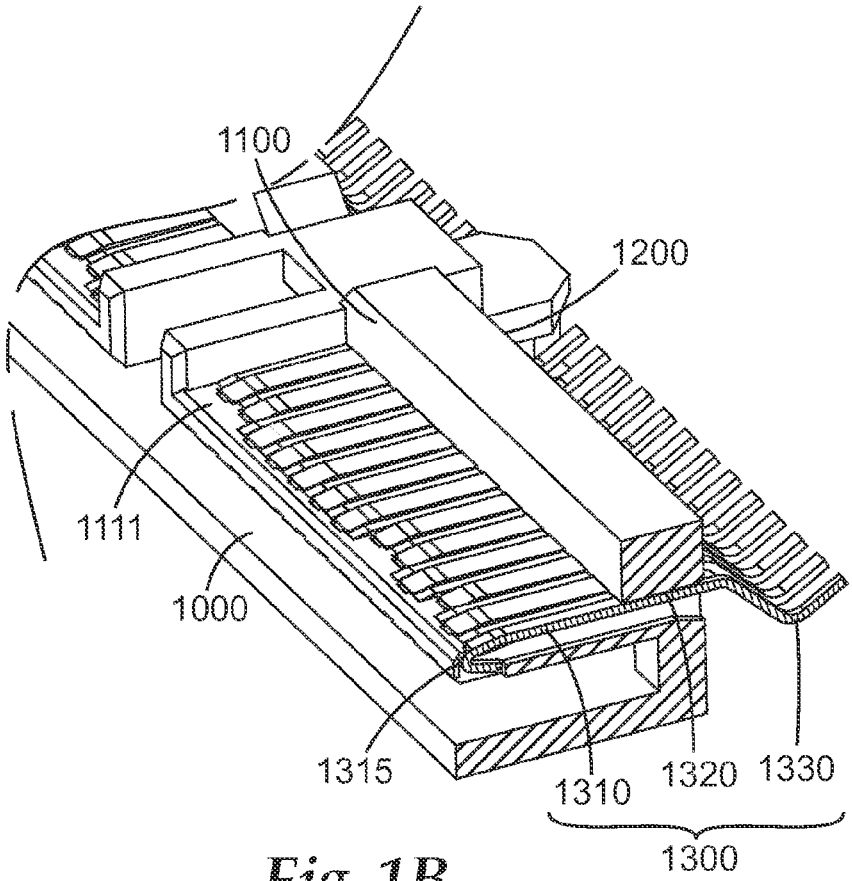
FIG. 1B shows a section of the electrical connector of FIG. 1A with a plurality of contacts in place within the electrical connector.
Figure 1C:
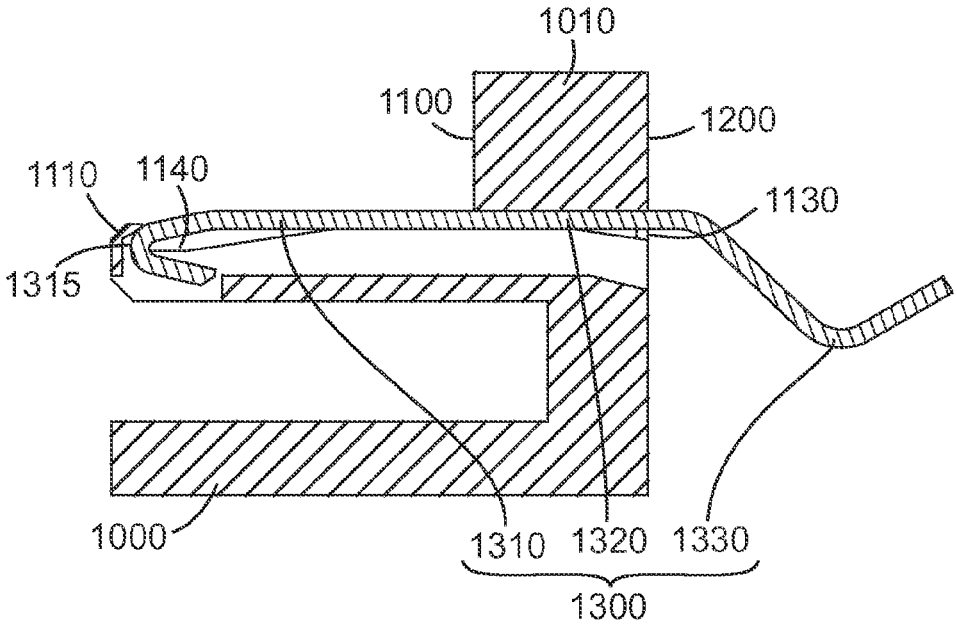
FIG. 1C shows a side view of a cross-section of the electrical connector of FIG. 1B.

FIG. 1A shows an exploded, perspective view of an exemplary electrical connector in accordance with the present invention. FIGS. 1B and 1C show views of the electrical connector of FIG. 1A with a plurality of contacts in place within the electrical connector.

Referring to FIGS. 1A, 1B and 1C, the electrical connector 10 comprises an insulative housing 1000 comprising a longitudinal base 1010 having a mating side 1100 and a mounting side 1200. At the mating side 1100, there is a tongue portion 1110 extending from the longitudinal base 1010, the tongue portion 1110 comprising a first tongue section 1111 and a second tongue section 1112, each tongue section having a first face 1121 and a second face 1122.

Defined on the first face 1121 of the first tongue section 1111 and of the second tongue section 1112 are a plurality of passageways 1130 extending from the tongue sections 1111, 1112 to the mounting side 1200. At one end of each passageway 1130 is a recess 1140 preferably configured near the edge of the tongue sections 1111, 1112.

Figure 2:
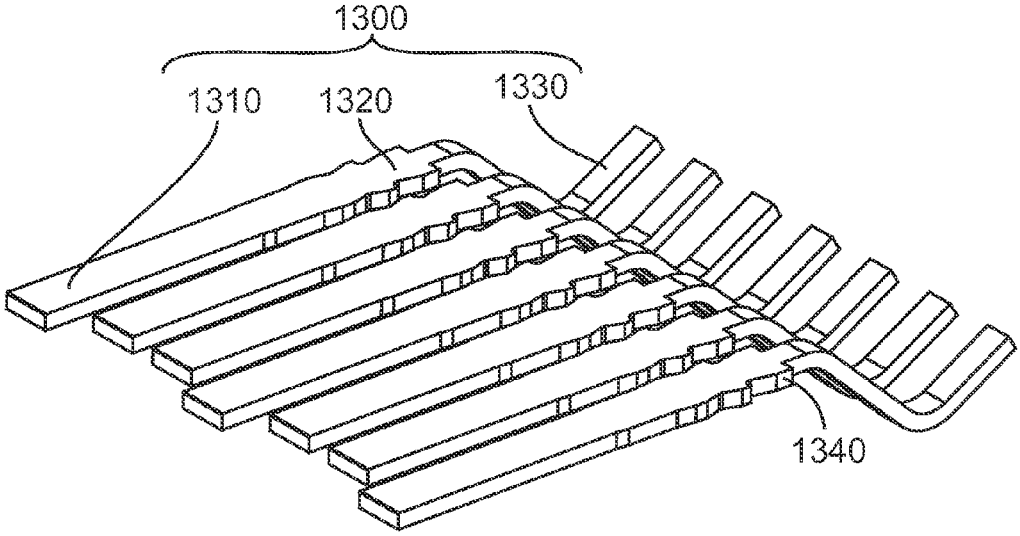
FIG. 2 shows a perspective view of one embodiment of a set of contacts according to the present invention.

Received in the plurality of passageways 1130 is a set of conductive contacts 1300, each contact 1300 comprising a mating section 1310 located at the mating side 1100, a mounting section 1330 located at the mounting side 1200 and a retainer section 1320 bridging the mating section 1310 to the mounting section 1330. FIG. 2 shows another embodiment of the contacts in accordance with this invention.

Preferably, the mating section 1310 of the contact 1300 is configured with a bend 1315 at one end. As shown in FIG. 1C, the bend 1315 helps in the proper positioning of the contact 1300 along the passageway 1130 within the insulative housing 1000 by preventing the contact 1300 from going beyond the tongue portion 1110 as the contact 1300 is inserted into the insulative housing 1000 from the mounting side 1200 during installation.

As shown in FIGS. 1A and 2, in one embodiment, the retainer section 1320 further comprises a plurality of retaining devices 1340 such as, e.g., barbs. The electrical connector 10 may be electrically connected to a printed circuit board via the mounting section 1330 of the contact 1300. There are many ways of mounting the electrical connector 10 on the printed circuit board including but not limited to, adapting the mounting section 1330 for surface mounting, press-fitting or through-hole mounting, all of which are within the spirit of this invention.

In one embodiment of the present invention, the electrical connector 10 further comprises a plurality of alignment guides 1400, 1410 used for guiding a complementary electrical connector (not shown) or a printed circuit board (not shown) to engage the electrical connector 10 during mating.

Figure 3:
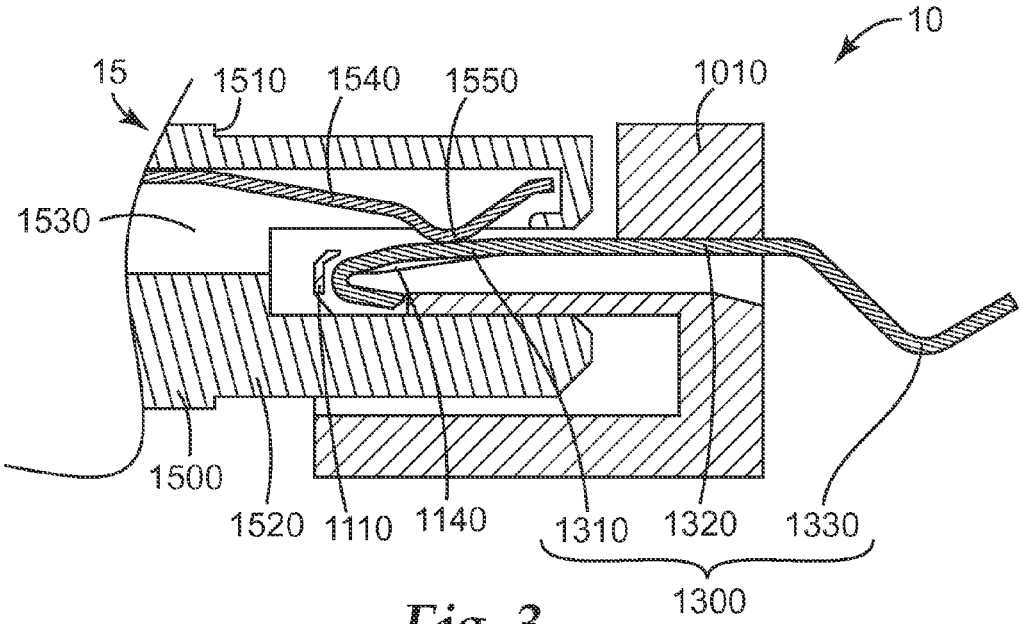
FIG. 3 shows a side view of a cross-section of the electrical connector of FIG. 1B engaged with a complementary electrical socket.

FIG. 3 shows a side view of a part of a cross-section of a complementary electrical connector 15 engaged with the electrical connector 10 when the electrical connector 10 is mated with the complementary electrical connector 15. The complementary electrical connector 15 comprises an insulative housing 1500 having a mating end 1510; a socket 1520 extending from the insulative housing 1500 at the mating end 1510; a plurality of slots 1530 defined in the insulative housing 1500 extending into the socket 1520; and wherein in each slot 1530 a terminal 1540 is placed. At one end of the terminal 1540 is a bend 1550 configured to establish electrical connection with the contact 1300 in the electrical connector 10 when the electrical connector 10 is mated with the complementary electrical connector 15.

As the socket 1520 of the complementary electrical connector 15 engages the tongue portion 1110 of the electrical connector 10 during mating, the bend 1550 abrades the surface of the contact 1300 as the terminal 1540 moves in a direction opposite to that of the contact 1300. Similar surface abrasion also takes place during an-mating cycle whereby the socket 1520 of the complementary electrical connector 15 disengages the tongue portion 1110 of the electrical connector 10. Such repeat abrasions will ultimately wear the contacts 1300 resulting in poor electrical connection between the two connectors when in use.

By having a recess 1140 at one end of the passageway 1130, preferably in close proximity to the edge of the tongue portion 1110, the contact 1300 at the mating section 1310 is able to flex towards the recess 1140 as the bend 1550 meets the contact 1300 when the socket 1520 of the complementary electrical connector 15 engages the tongue portion 1110 of the electrical connector 10. This reduces the amount of force by the terminal 1540 on the contact 1300, and therefore reduces the amount of abrasion on the surface of the contact 1300 caused during the mating and the un-mating process, thereby prolonging the life (in terms of number of mating cycles) of the electrical connector 10.

Preferably, there is a slope leading from the passageway 1130 to the recess 1140. This will further reduce the amount of abrasion on the surface of the contact 1300 especially at the location where the bend 1550 first meets the contact 1300.

Figure 4:
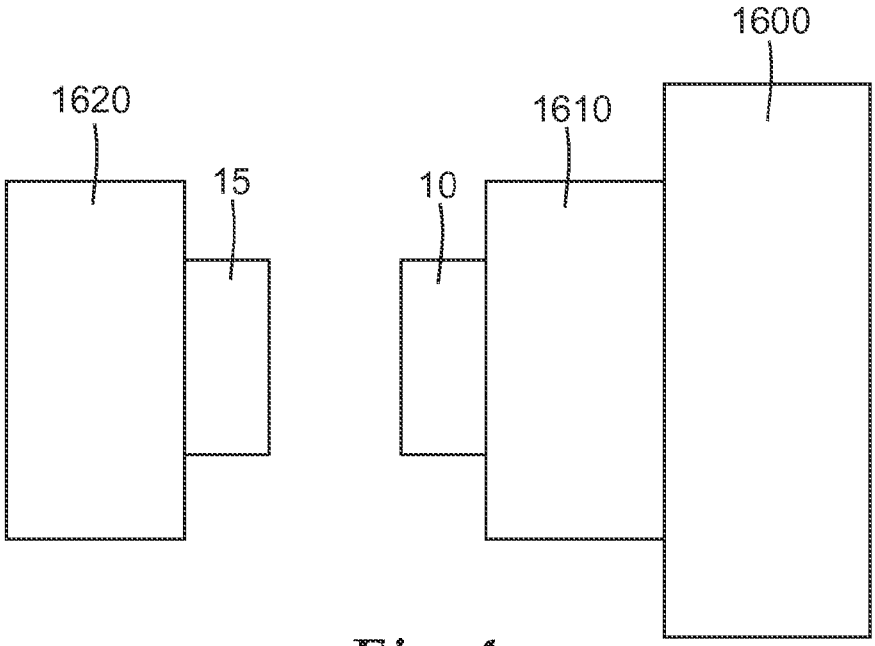
FIG. 4 shows a block diagram illustration of a hard disk drive testing setup.

The exemplary electrical connector 10 as mentioned in this specification is useful for many applications including but not limited to, the quality testing of hard disk drives. With reference to FIG. 4, in a hard disk drive testing environment, one may find the exemplary connector 10 mounted on a printed circuit board 1610 of a hard disk drive testing equipment 1600 and the complementary electrical connector 15 coupled to a hard disk drive 1620 that is to be tested. The electrical connector 10 is often securely bonded (for example by means of soldering) to the printed circuit board 1610 so as to prevent the accidental disengagement of the electrical connector 10 from the printed circuit board 1610 caused by the force due to the repeated exchange of the hard disk drives 1620 undergoing testing. Any failure of the electrical connector 10 due to the abrasion of the contacts 1300 will require the electrical connector 10 to be replaced. This may result in a loss of productivity since there is effort required to de-solder the faulty electrical connector and solder a new electrical connector on the printed circuit board before the hard disk drive testing equipment can be used. Therefore, by increasing the life (number of mating cycles) of the electrical connector 10, the period between the electrical connector replacement will be lengthen and the productivity will be increased since there is less machine downtime.

Figure 5A:
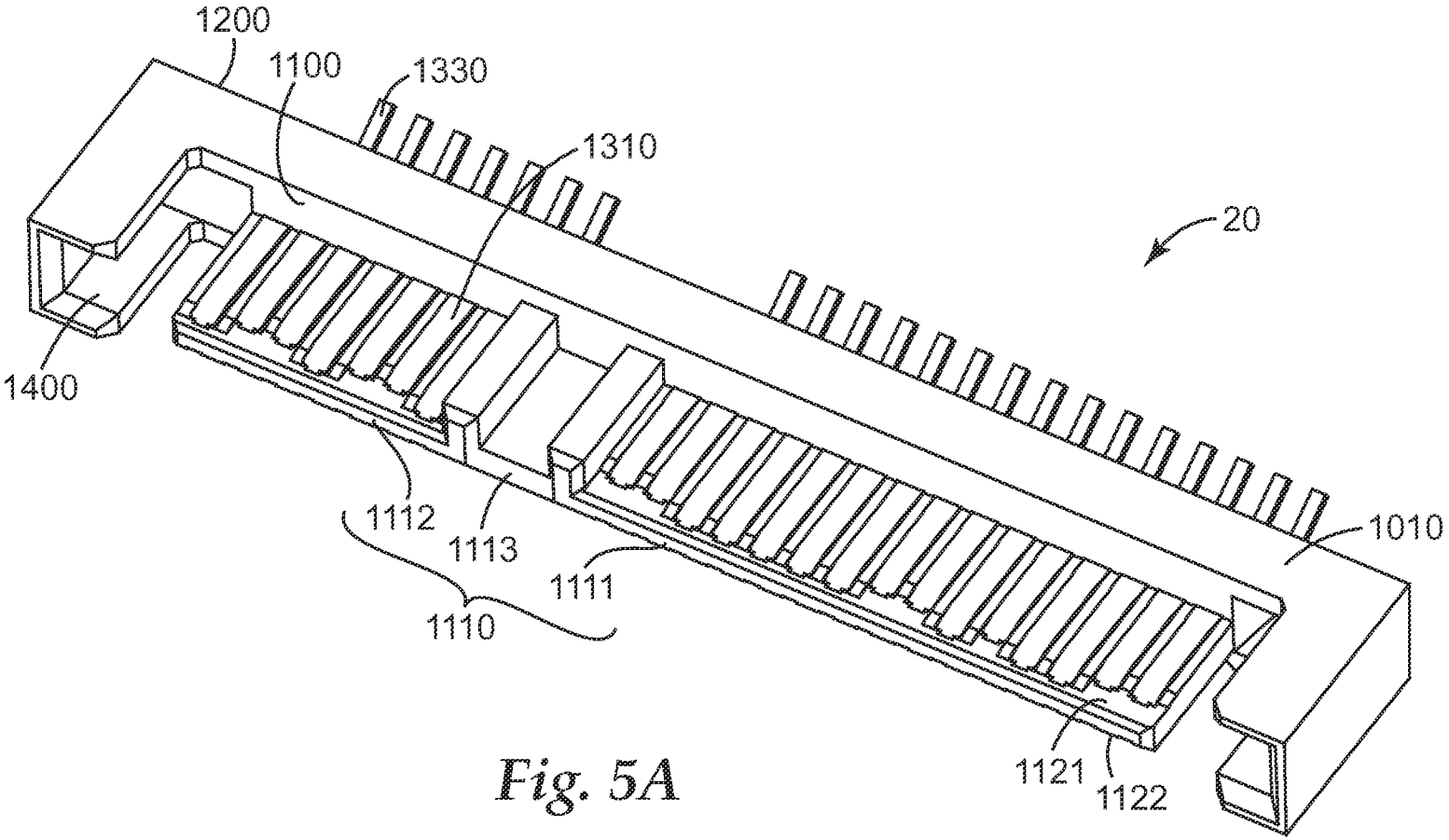
FIG. 5A shows a top perspective view of another embodiment of an exemplary electrical connector according to the present invention.
Figure 5B:
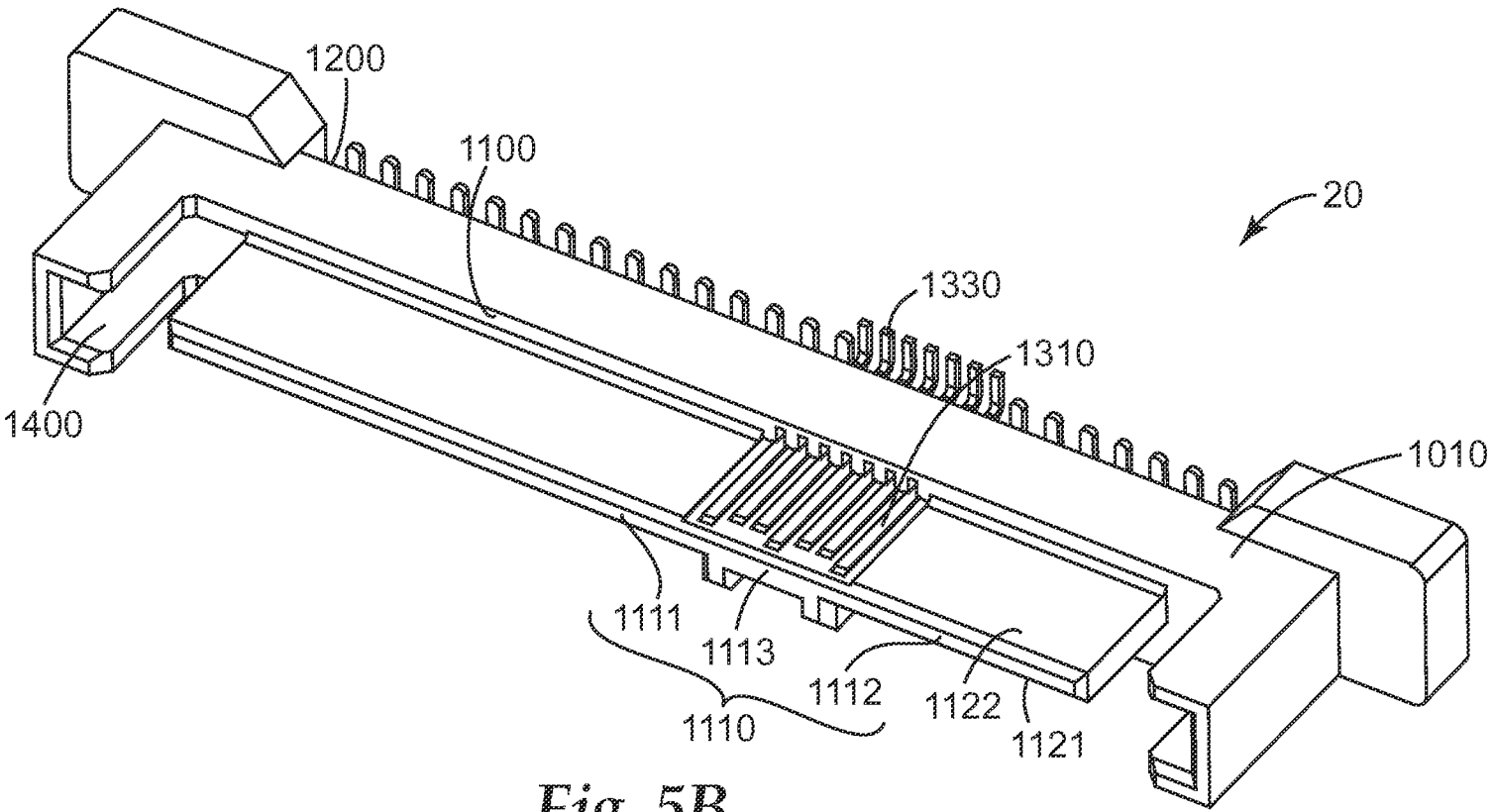
FIG. 5B shows a bottom perspective view of the exemplary electrical connector of FIG. 5A.

FIGS. 5A and 5B show a top perspective view and a bottom perspective view of another embodiment of an exemplary electrical connector 20 in accordance to the present invention. In addition to the elements present in the electrical connector 10 that are mentioned in the earlier sections of this specification, the electrical connector 20 further comprises a third tongue section 1113 connecting with the first and the second tongue sections 1111, 1112, the third tongue section 1113 having a first face 1121 and a second face 1122 and with a plurality of passageways 1130 defined on the second face 1122, and each passageway 1130 having a recess 1140 located at one end. A plurality of conductive contacts 1300 are received in the passageways 1130, each contact 1300 comprising a mating section 1310, a mounting section 1330 and a retainer section 1320 bridging the mating section 1310 to the mounting section 1330 wherein the mating section 1310 is free to flex into the recess 1140.

Figure 6A:
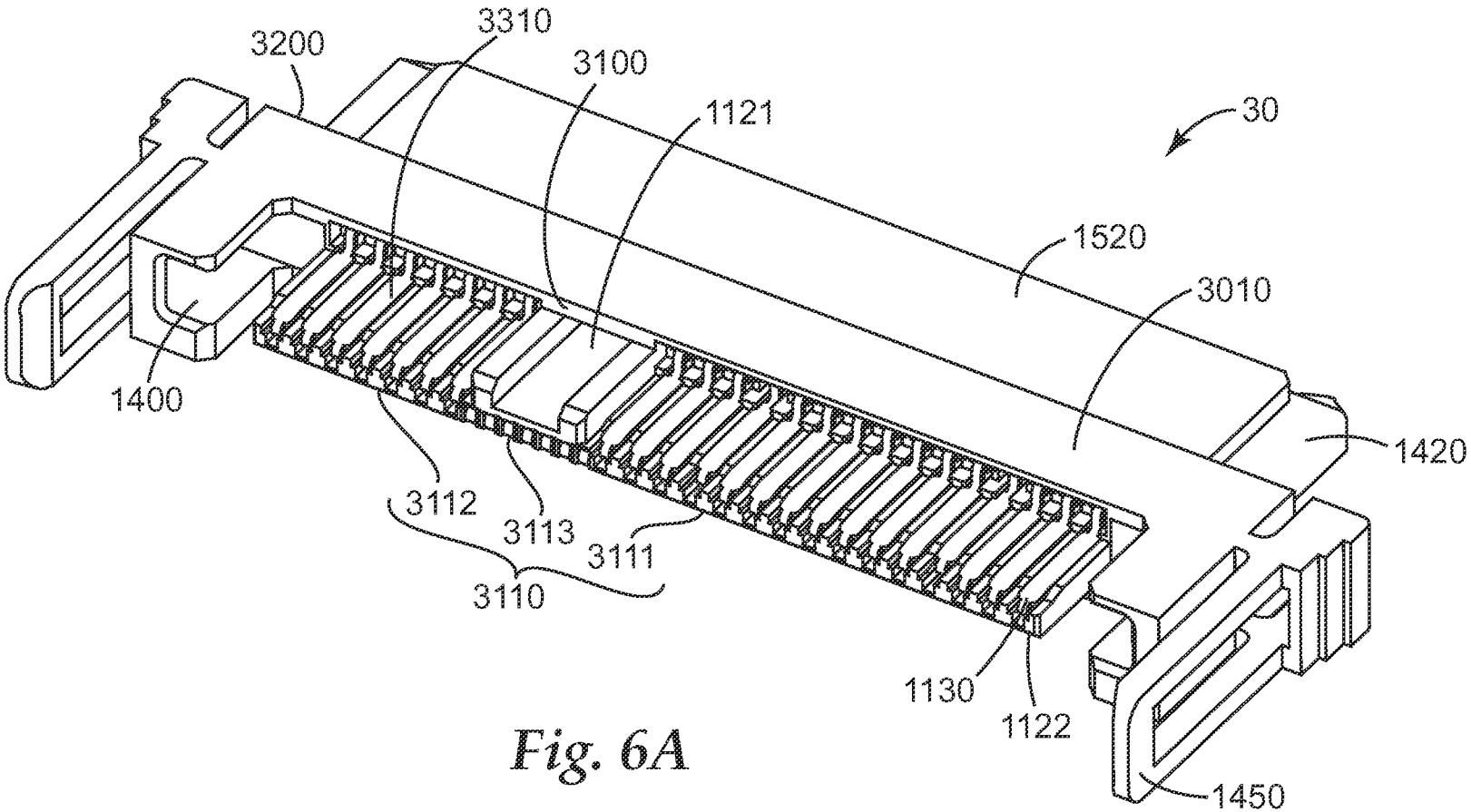
FIG. 6A shows a front perspective view of another embodiment of an exemplary electrical connector according to the present invention.
Figure 6B:
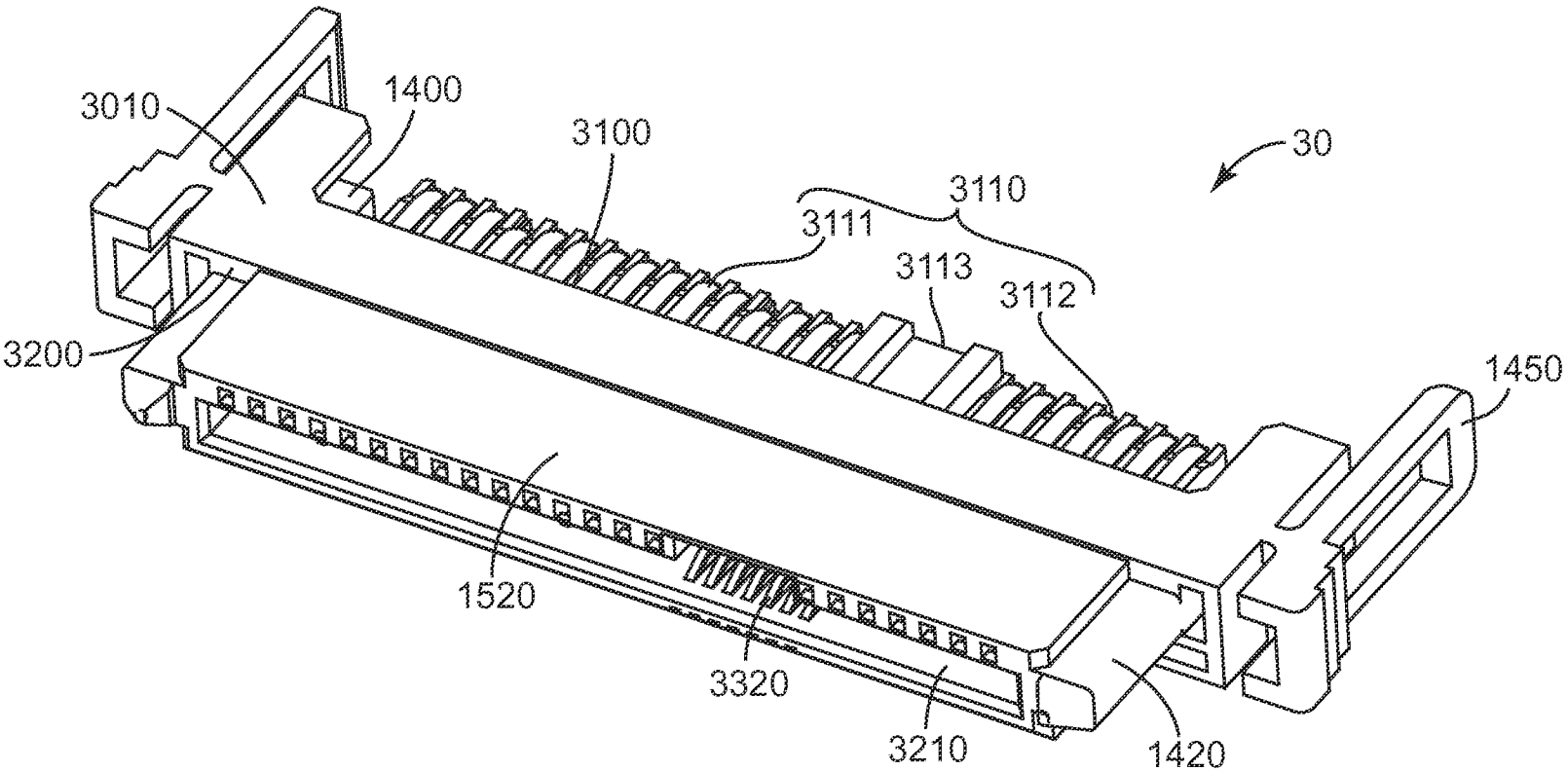
FIG. 6B shows a rear perspective view of the exemplary electrical connector of FIG. 6A.

FIGS. 6A and 6B show a top perspective view and a bottom perspective view of another embodiment of an exemplary electrical connector 30 in accordance to the present invention. The electrical connector 30 comprises an insulative housing comprising a longitudinal base 3010 having a first mating side 3100 and a second mating side 3200. At the first mating side 3100, there is a tongue portion 3110 extending from the longitudinal base 3010, the tongue portion 3110 comprising a first tongue section 3111 and a second tongue section 3112. In another embodiment of the present invention, the tongue portion 3110 further comprises a third tongue section 3113 connecting with the first and the second tongue sections 3111, 3112. Each tongue section in the tongue portion 3110 comprises a first face 1121 and a second face 1122.

At the second mating side 3200, there is a socket 1520 extending from the longitudinal base 3010, the socket 1520 further comprising a mating slot 3210 (as shown in FIG. 6B) which is configured to accept the tongue portion of a complementary connector (not shown).

Defined on the first face 1121 of the first tongue section 3111 and the second tongue section 3112 as well as on the second face 1122 of the third tongue section 3113 are a plurality of passageways 1130 extending from the tongue portion 3100 to the socket 1520. At one end of each passageway 1130 is a recess 1140 (as shown in FIG. 1C) preferably configured near the edge of the tongue sections 3111, 3112 and 3113.

Received in the plurality of passageways 1130 is a set of conductive contacts, each contact comprising a first mating section 3310 located at the first mating side 3100, a second mating section 3320 located at the second mating side 3200 and a retainer section (not shown) bridging the first mating section 3310 to the second mating section 3320.

In one embodiment of the present invention, the electrical connector 30 further comprises a plurality of alignment posts 1420 used for aligning a complementary electrical connector (not shown) with the electrical connector 30 during mating.

In another embodiment of the present invention, the electrical connector 30 further comprises a plurality of securing devices 1450 used for securing another complementary electrical connector (not shown) to the electrical connector 30 to prevent accidental disengagement of the two connectors when in use.

Figure 7:
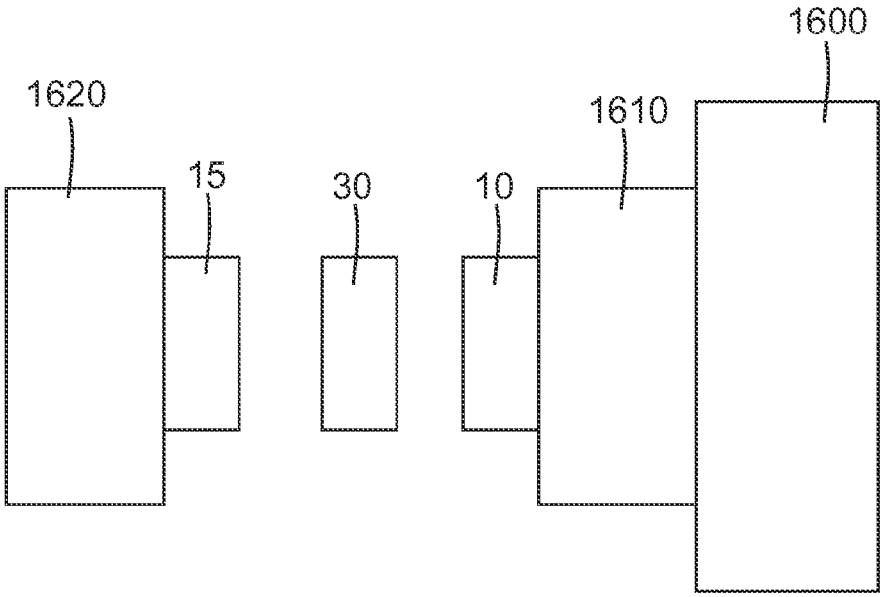
FIG. 7 shows a block diagram illustration of a hard disk drive testing setup with a sacrificial electrical connector.

To further reduce the loss of productivity arising from machine downtime due to the need to replace the worn out electrical connector (as a result of severely abraded conductive contacts) coupled to the printed circuit board of a hard disk drive testing equipment, the electrical connector 30 may be used as illustrated in FIG. 7. By using the electrical connector 30 as a sacrificial connector, the occurrence of mating and un-mating at the electrical connector coupled to the printed circuit board of the hard disk drive testing equipment, reduces. As a result, the conductive contacts in the electrical connector coupled to the printed circuit board of the hard disk drive testing equipment do not get abraded easily. Of course, it will be appreciated that the various embodiments of electrical connectors described and shown herein are suitable for this purpose.

The foregoing description of the preferred embodiment of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order to best explain the principles of the invention and its practical application, thereby to enable others skilled in the art to use the invention in various embodiments and with various modifications as are suited to the particular use contemplated thereof. It is intended that the scope of the invention be defined by the claims appended hereto, when interpreted in accordance with the full breadth to which they are legally and equitably entitled.

The invention claimed is:

1. An electrical connector comprising:

an insulative housing comprising a longitudinal base having a mating side and a mounting side;

a tongue portion extending from the longitudinal base at the mating side, the tongue portion comprising a first tongue section and a second tongue section, each tongue section having a first face and a second face;

a plurality of passageways defined on the first faces of the first and the second tongue sections, the passageways extending from the tongue portion to the mounting side of the insulative housing;

a recess located at one end of each passageway; and a plurality of conductive contacts received in the passageways, each contact comprising a mating section located at the mating side of the insulative housing, a mounting section located at the mounting side of the insulative housing, and a retainer section bridging the mating section to the mounting section; wherein the mating section of the contact is free to flex into the recess.

2. The electrical connector as claimed in claim 1 further comprising a third tongue section connecting with the first and the second tongue sections, the third tongue section having a first face and a second face and with a plurality of passageways defined on the second face, each passageway having a recess located at one end; a conductive contact received in the passageway comprising a mating section, a mounting section, and a retainer section bridging the mating section to the mounting section;

wherein the mating section of the contact is free to flex into the recess.

3. An electrical connector comprising:

an insulative housing comprising a longitudinal base having a first mating side and a second mating side;

a tongue portion extending from the longitudinal base at the first mating side and a socket extending from the longitudinal base at the second mating side; wherein the tongue portion comprises a first tongue section and a second tongue section, each tongue section having a first face and a second face;

a plurality of passageways defined on the first faces of the first and the second tongue sections, the passageways extending from the tongue portion at the first mating side to the socket at the second mating side;

a recess located at one end of each passageway; and a plurality of conductive contacts received in the passageways, each contact comprising a first mating section located at the first mating side of the insulative housing, a second mating section located at the second mating side of the insulative housing, and a retainer section bridging the first mating section to the second mating section; wherein the first mating section of the contact is free to flex into the recess.

4. The electrical connector as claimed in claim 3 further comprising a third tongue section connecting with the first and the second tongue sections, the third tongue section having a first face and a second face and with a plurality of passageways defined on the second face, each passageway having a recess located at one end; a conductive contact received in the passageway comprising a mating section, a mounting section, and a retainer section bridging the mating section to the mounting section;

wherein the mating section of the contact is free to flex into the recess.

5. An interconnect system comprising the electrical connector as claimed in claim 1 and further comprising a first electronic device having a complementary electrical socket coupled to the electrical connector at the mating side;

the electrical connector optionally mounted to a printed circuit board of a second electronic device at the mounting side.

6. An interconnect system comprising the electronic connector as claimed in claim 3 and further comprising a complementary electrical socket coupled to the electrical connector at the first mating side and a complementary electrical header coupled to the electrical connector at the second mating side.

* * * * *